US009453351B2

(12) United States Patent
Schabelreiter et al.

(10) Patent No.: US 9,453,351 B2
(45) Date of Patent: Sep. 27, 2016

(54) BOOM CONSTRUCTION FOR A TRUCK-MOUNTED CONCRETE PUMP

(71) Applicant: Schwing GMBH, St. Stefan (AT)

(72) Inventors: Johann Schabelreiter, Pernegg (AT); Horst Jöbstl, Wolfsberg (AT); Roland Steinbauer, St. Stefan (AT)

(73) Assignee: Schwing GmbH, St. Stefan (AT)

( * ) Notice: Subject to any disclaimer, the term of this patent is extended or adjusted under 35 U.S.C. 154(b) by 318 days.

(21) Appl. No.: 14/357,762

(22) PCT Filed: Nov. 7, 2012

(86) PCT No.: PCT/EP2012/004639

§ 371 (c)(1),
(2) Date: May 12, 2014

(87) PCT Pub. No.: WO2013/068112

PCT Pub. Date: May 16, 2013

(65) Prior Publication Data

US 2014/0325976 A1 Nov. 6, 2014

(30) Foreign Application Priority Data

Nov. 10, 2011 (AT) ..... A 1661/2011

(51) Int. Cl.

| | |
|---|---|
| ***F15B 15/06*** | (2006.01) |
| ***E04G 21/04*** | (2006.01) |
| ***B66C 23/00*** | (2006.01) |
| ***B66C 23/68*** | (2006.01) |

(52) U.S. Cl.

CPC ..... *E04G 21/0445* (2013.01); *B66C 23/54* (2013.01); *B66C 23/68* (2013.01); *E04G 21/0436* (2013.01); *F15B 15/061* (2013.01); *Y10T 137/6881* (2015.04)

(58) Field of Classification Search

CPC .... F15B 15/061; F15B 15/063; B66C 23/54; E04G 21/04

See application file for complete search history.

(56) References Cited

U.S. PATENT DOCUMENTS 3,685,543 A * 8/1972 Schwing ..... E04G 21/04 137/351

(Continued)

FOREIGN PATENT DOCUMENTS

| | | |
|---|---|---|
| CN | 201730339 U | 2/2011 |
| DE | 3339495 A1 | 7/1984 |

(Continued)

OTHER PUBLICATIONS

International Search Report and Written Opinion issued in PCT/EP2012/004639, mailed Feb. 27, 2013, 11 pages (Translation).

*Primary Examiner* — Thomas E Lazo
(74) *Attorney, Agent, or Firm* — Faegre Baker Daniels LLP

(57) ABSTRACT

A boom construction for truck-mounted concrete pumps has at least a first boom arm and a second boom arm that are articulatedly jointed to each other and that are rotatable relatively to each other about an axis. A drive pivots the boom arms. A piston-cylinder arrangement and a gear transform piston reciprocating movement into rotary movement for boom arm pivoting, said arrangement having first and second pistons that form part of the gear and that interact with outer rings of the gear.

16 Claims, 7 Drawing Sheets

(56) References Cited

U.S. PATENT DOCUMENTS

| | | | | | |
|---|---|---|---|---|---|
| 4,625,760 | A | * | 12/1986 | Mertens | E04G 21/04 137/615 |
| 4,771,646 | A | * | 9/1988 | Ruggier | F16H 27/02 409/221 |
| 5,460,301 | A | * | 10/1995 | Ebinger | E04G 21/04 137/625 |

FOREIGN PATENT DOCUMENTS

| | | | |
|---|---|---|---|
| DE | 69801997 | T2 | 5/2000 |
| EP | 0894915 | A1 | 2/1999 |
| EP | 1486680 | A1 | 12/2004 |
| FR | 2907869 | A1 | 5/2008 |
| WO | WO2011094981 | A1 | 8/2011 |

* cited by examiner

BOOM CONSTRUCTION FOR A TRUCK-MOUNTED CONCRETE PUMP

CROSS-REFERENCE TO RELATED APPLICATION

This application is a national phase application of PCT application No. PCT/EP2012/004639, internationally filed Nov. 7, 2012, which claims priority to Austrian Application No. A 1661/2011, filed Nov. 10, 2011, both of which are herein incorporated by reference in their entirety.

TECHNICAL FIELD

The invention relates to a boom construction or assemblies for a truck-mounted concrete pump.

BACKGROUND

Boom constructions or assemblies on trucks and other vehicles generally have at least two boom arms flexibly connected to each other by an articulated joint via a swivel axis are utilized for various working devices such as excavators. One application is with concrete pumps, whether stationary or mobile, such as truck-mounted concrete pumps. In this application, the boom arms carry concrete delivery lines to discharge the concrete at desired locations. On construction of the building structure, the individual boom arms can be extended by swiveling, resulting in a change of the boom geometry and thus making it possible to reach different locations on site through the boom. With a boom, concrete can be delivered relatively large distances, for example, from the concrete pump to the place of pouring the concrete on construction site. On account of the large range of the boom, it is subjected to significant loads which essentially originate from the concrete-carrying delivery line running the length of the boom and from the concrete carried therein.

When used in conjunction with truck-mounted concrete pumps, it is not allowed to exceed the load limits of the relevant vehicle types, which in most cases are vehicles admitted for traffic on public roads, in particular trucks. While the masses of the delivery lines of concrete can hardly be influenced, if at all, achieving a greater range of the boom calls for optimizing its masses.

The articulated joints between the boom arms are exposed to high requirements. To obtain a sufficiently powerful drive, coupler gear mechanisms in the kind of double-acting hydraulic cylinders, so-called thrust piston gears are mostly utilized for the swiveling motion. However, due to the components of the coupler gear mechanisms and the linear drive units associated therewith, they have a relatively heavy weight and call for substantial space which is due to their construction style. But this is problematic because such truck-mounted concrete pumps are mounted on vehicles which have to be licensed for operation in road traffic and therefore are subject to certain codes and rules with regard to their width and length. Furthermore, thrust piston gears applied here have a disadvantage in that the angular velocity during the swiveling motion is relatively uneven. Therefore, to ensure safe operation of this boom construction, the use of hydraulic load holding valves at the hydraulic cylinders is mandatory, because their yielding would cause an impermissible change of the rotary angle between the boom arms. Add to this that for such coupler gear mechanisms in the kind of thrust piston gears, even the swiveling of the two boom arms towards each other is only feasible in restricted extent, thus prompting a limitation in the effect and function.

Since with multiple-arm boom constructions, the predominant load in the last boom arms is usually less than in the first boom arms, even hydraulic rotary drives (DE 698 01 997 T1) are in some cases used at the articulated joints towards the boom end in prior art as an alternative to the kinematic system described before, whereby it is possible to achieve uniform angular velocities. Though these means are relatively small in size and thus lighter in weight as compared to coupler gear mechanisms and/or thrust piston gears, but the required driving moments are not available that are needed for swiveling the articulated joints of boom arms in the lower boom area, too. Besides, when applying such hydraulic rotary drives for load pick-up devices such as hinged arms of manipulators, boom arms and the like, the problem arises in that the load pick-up device and/or the boom arm when deactivating the rotary drive due to a leakage, for example, still stays rotatable and can swivel and/or pivot. However, as has been outlined hereinabove, such a twisting with a deactivated drive is impermissible with these applications, in particular for truck-mounted concrete pumps, which is the reason why in prior art appropriate braking devices are used on rotary drives, for example multiple disk brakes, in order to prevent twisting of the boom arms in case of a deactivated rotary drive. With such multiple disk brakes, lamella-like brake disk pairs are pressed against each other to prevent a twisting of the boom arms relatively to each other, these parts here being real wear parts. It is also known from prior art realizing a brake by preventing the flow-off of hydraulic fluid from at least one pressure chamber by means of separate shutoff devices. However, those measures are comparably costly and susceptible to faults.

Finally, U.S. Pat. No. 4,771,646A discloses a device by way of which a rotary motion can be generated. Accordingly, a component hydraulically moved back and forth is so guided by a journal and sprocket assembly that a rotation motion is developed.

SUMMARY

One embodiment provides a boom construction, in particular for truck-mounted concrete pumps and/or a truck-mounted concrete pump comprised of such boom constructions, wherein the boom arms can be uniformly pivoted and/or swiveled even under load with constructively simple, robust and space-saving means over a large swivel angle and the boom arms can be arrested in each swivel and/or pivoting position without any major expenditure. At the same time it can enable a compact and evenly balanced construction style.

This can be achieved for a boom construction by the measures recited in one or more of the claims herein.

Annular pistons sit in an axially slidable arrangement on an inner ring and are torque-proof connected to it which can expediently be accomplished by form fitting, in particular by a splined serration and/or toothing between the annular piston and the inner ring. Sitting on this inner ring which is preferably configured stock-like, axle-like, shaft-like or like a hollow cylinder and provided with an annular flange at one end, are the outer rings which interact with the annular pistons, wherein the outer rings are pivoted relatively to the inner ring, but axially defined versus the inner ring and/or at the inner ring. The outer rings in particular form components of the rotary drive casing. The hydraulic rotary drive thus needs little quantities of components and thus it is largely unsusceptible to wear and low in maintenance.

Each annular piston is equipped with two counter-directional spur serrations which interact with the complementary ring-shaped spur gear serrations at the outer rings. Since the annular pistons are alternately moved back and forth, the spur serrations of the annular pistons each engage into the corresponding spur serrations of the outer rings, wherein the driving flanks each accomplish a twisting of the outer rings via the spur serrations. If the rotary drive fails to work or if the rotary drive is deactivated in any other manner, a self-arresting effect is accomplished due to the position of indentation of these various spur serrations so that the angular position once taken is in principle not changed any more. Hence there is no longer any need for separate braking devices.

The inner ring comprises a ring-type flange and on its other side it is provided with a cover. The cover and the ring-type flange may be connectible to the inner ring through bolted unions. Arranged between the cover and the ring-type flange are the annular pistons and outer rings, thus they are arranged space-saving in the narrowest of spaces. The structure composed of the cover, ring-type flange, inner ring and outer rings thus forms the cylinder for the annular pistons accommodated therein and movable back and forth because of the hydraulic fluid feed, said annular pistons moving back and forth and thus alternately engaging with the corresponding complementary spur serrations of the outer rings, thus providing for the drive.

Accordingly, it is self-evident that the interacting spur serrations of the annular pistons and outer rings point to each other, i.e. either pointing away from the ring-type flange of the inner ring or pointing in the direction of the ring-type flange. Spur serration, as illustrated in the drawing, means that the teeth are not directed radially but axially. Accordingly, the tooth flanks of the spur serrations are so configured that owing to the position of indentation between the interacting spur serrations, the stroke drive of the pistons is transformed into a rotary movement of the outer rings.

In accordance with the invention, two annular pistons surrounded by three outer rings are expediently utilized for a hydraulic drive. As a matter of fact, it is also feasible to implement more annular pistons on a rotary drive, wherein correspondingly more outer rings are then provided for. However, it is also possible to utilize several rotary drives arranged one behind the other instead of one rotary drive.

The cohesion of the individual components of the rotary drive is accomplished in a simple manner by means of bolted unions, wherein the cover and the ring-type flange are bolted to the inner ring, and wherein the outer rings may be bolted to each other via radially protruding ring-type shoulders. To this effect, there are several bolting openings for engagement of the bolted unions spread around the circumference. As a matter of fact, the piston spaces and/or the pistons are sealed in appropriate manner which also applies to the individual components of the cylinder arrangement, which however is at the discretion of expert-like workmanship and therefore need not be described and/or illustrated specifically.

The annular pistons are expediently driven with a stroke offset versus each other, preferably offset by half a stroke versus each other in case of two annular pistons. Accordingly, one piston thereof is located in its end position whereas the other piston is located in a middle position. The annular pistons are expediently chargeable on both sides so that there are two hydraulic connections provided for each piston. The control of the annular piston stroke is expediently, though not mandatorily, performed mechanically, i.e. by the aid of a suitable control disk which determines the switching pulses for the relevant hydraulic valves for hydraulic fluid supply. The directional change of the rotary drive, i.e. reversion in the direction of rotation, is accomplished in a simple manner by reversing the stroke sequence of the annular pistons prompted by the suitable stroke offset of the drive of both pistons.

Further, a boom construction for truck-mounted concrete pumps includes at least a first boom arm and a second boom arm that are articulatedly jointed to each other and that are rotatable relatively to each other about an axis. A drive pivots the boom arms. A piston-cylinder arrangement and a gear transforms piston reciprocating movement into rotary movement for boom arm pivoting, said arrangement having first and second hydraulically driven annular pistons that form part of the gear and that interact with outer rings of the gear.

Still further, a concrete pump vehicle includes a vehicle, a concrete pump on the vehicle, a delivery line connected to the concrete pump, and a boom construction on the truck and connected to the delivery line. The boom construction includes at least two boom arms with at least one boom arm being pivotable relative to the other boom arm, and a piston-cylinder arrangement and a gear for transforming piston reciprocating movement into rotary movement for boom arm pivoting. The arrangement has first and second pistons that form part of the gear and that interact with outer rings of the gear.

Further, a hydraulic rotary drive for a boom construction or a turntable carrying a boom construction, wherein the boom construction has at least two boom arms and wherein the drive includes a piston-cylinder arrangement and a gear for transforming piston reciprocating movement into rotary movement for boom arm pivoting. The arrangement has first and second pistons that form part of the gear and that interact with outer rings of the gear.

Within the scope of the present invention, independent protection is also sought for the truck-mounted concrete pump as well as for the hydraulic rotary drive as described hereinabove, which can also be utilized for other applications such as excavators, cranes, drive of a turntable for swiveling superstructures and the like.

BRIEF DESCRIPTION OF THE DRAWINGS

An example is described in the following based on the relevant drawings. These drawings are schematic and non-restrictive nature.

DETAILED DESCRIPTION OF VARIOUS EMBODIMENTS

Figure 1:
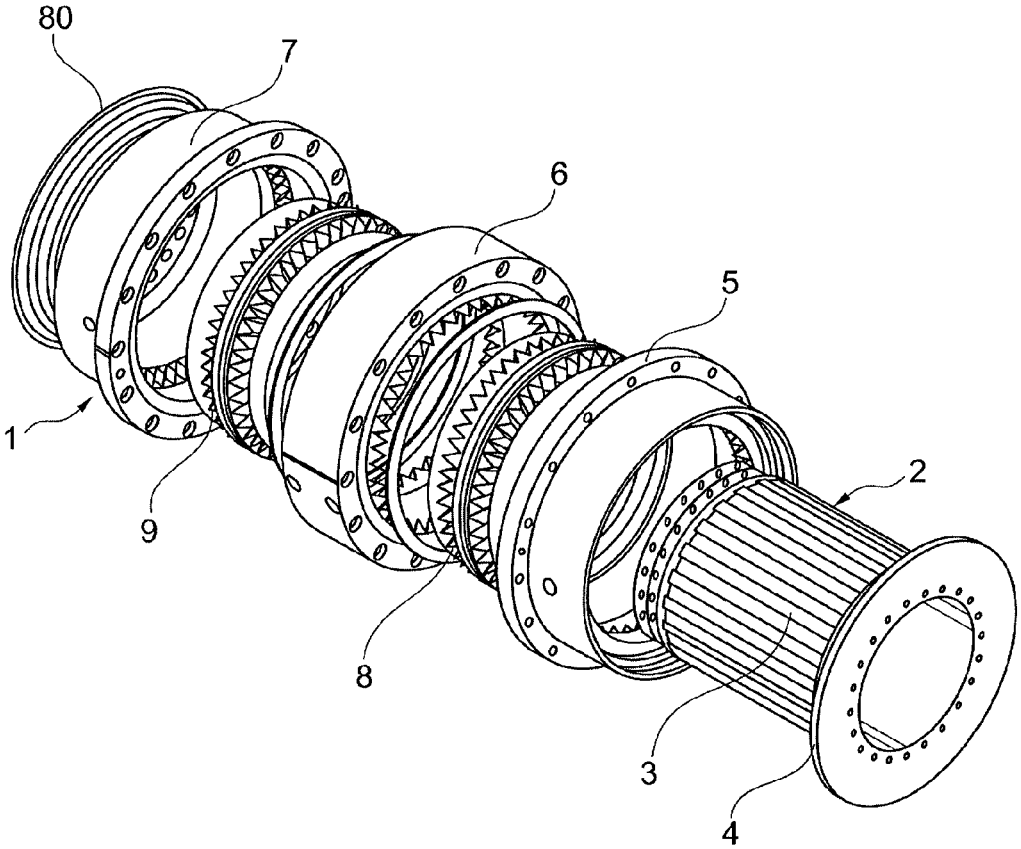
FIG. 1 is an exploded view of an embodiment of the hydraulic drive.

One of various contemplated embodiments with various contemplated features, components and other aspects is shown in FIG. 1, which is an exploded view of a hydraulic drive generally designated with reference number 1, which is utilized in particular as pivot drive for pivoting the hinge angle between two hinge arms of manipulators, in particular two boom arms of a boom construction. Boom constructions of this kind are utilized, among other applications, for truck-mounted concrete pumps. These boom constructions are composed of several boom arms arranged one behind the other and flexibly connected to each other which can be pivoted by way of the pivoting movement of the individual boom arms relatively to each other in various operating positions and into a swiveled-in idle position. With truck-mounted concrete pumps, the boom construction is usually arranged on a turntable mounted on the vehicle chassis. The boom construction furthermore carries pipe delivery lines for delivery of concrete. Such boom constructions, in particular for truck-mounted concrete pumps, are generally known to someone skilled in the art so that it need not be detailed any further. To this effect, reference is made to the general state of the art in technology.

The hydraulic swivel drive 1 according to FIG. 1 is comprised of one inner ring 2, which is designed as spline shaft and hence comprises a shaft-like spline section 3 provided with a splined serration. Furthermore, the inner ring is provided at one front-side end with a radially outwardly protruding ring-type flange 4. The drive according to FIG. 1 furthermore comprises three outer rings 5, 6, 7, thereof the outer ring 5 shown on the right side in FIG. 1 being arranged adjacent to the ring-type flange 4. It is then followed by the central outer ring 6 and finally by the outer ring 7 arranged on the left side and held on the spline shaft by a cover designated with reference number 80 which in turn is solidly linked, in particular bolted, to the front side of the inner ring 2. The set-up according to FIG. 1 furthermore comprises two annular pistons 8 and 9, which can be moved back and forth within the set-up under hydraulic translational control. The annular pistons 8, 9 are held axially slidable on the inner ring 2, but at the inner circumference they comprise splined serrations 10 and 11 more closely recognizable from FIG. 2 which interact with the splined serration 3 of the inner ring 2 so that after setting-down the annular pistons 8 and 9 these are axially slidable along the inner ring 2, but torque-proof connected to this inner ring, i.e. they are non-rotatable relative to the inner ring. It should be noted that for simplifying the representation, sealants as well as hydraulic connections are not shown in detail for such hydraulic rotary drives. These can be chosen at discretion, which however is a matter of fact to someone skilled in the art, so that it further detailing can be dispensed with.

Figure 2:
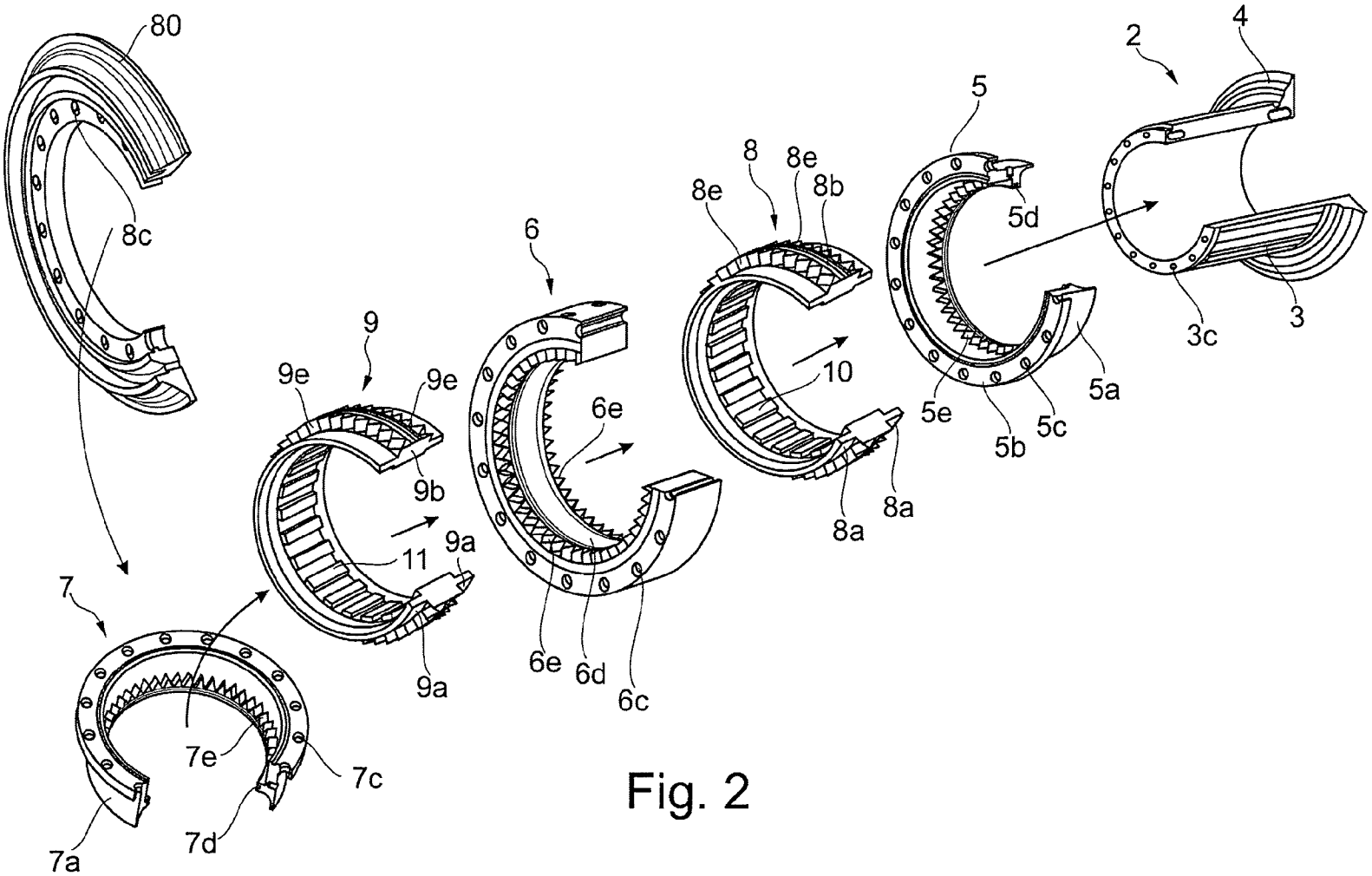
FIG. 2 also is an exploded view of the drive according to FIG. 1 for explanation of the sequence in mounting.

FIG. 2 shows a manner of assembly forming the swivel drive with the structural elements shown in FIG. 1. Visible here is the spline shaft with splined serration 3 representing the inner ring 2, wherein this inner ring configured as a shaft or stock is provided here at its end shown at right with a radially outwardly projecting and circumferentially configured ring-type flange 4. The function of this holding flange 4, as still described further below, is mainly a holding function for the structural elements arranged on it. Set-up onto this stock section of this inner ring 2 is initially the outer ring 5 shown at right in FIG. 2 and pushed with its right-side front end up to the ring-type flange 4, i.e. up to the stop, wherein the outer ring 5 forms a rotary bearing with the ring-type flange 4, because the outer ring is rotatable relative to the inner ring 2.

The outer ring 5 comprises a stock section 5*a* and an outwardly protruding circumferential ring-shaped radial flange 5*b* which is provided with bolt openings 5*c* spread around the circumference. Furthermore, the outer ring 5 at the end adjacent to the ring-type flange 4 is provided with a radially inwardly protruding ring shoulder 5*d*, at the radial surface of which a circumferential ring-shaped spur serration 5*e* is provided for.

An annular piston 8 is stuck into this outer ring 5. On both sides, this annular piston 8 comprises a stock section 8*a* and in central arrangement a circumferential ring-shaped outer shoulder 8*b*, at the two front faces of which spur serrations 8*e* are provided for which are opposing each other, i.e. the spur serration 8*e* shown at right in FIG. 2 points to the direction of the ring-type flange 4 and/or outer ring 5, whereas the spur serration 8*e* shown at left points to the other direction, i.e. away from the ring-type flange 4. Clearly visible from FIG. 2 is the splined serration 10 for torque-fixing of the piston in relation to the inner ring. The annular piston 8 here is inserted into the outer ring 5 thus far that it hits with its spur serration at the serration of the outer ring 5.

Finally, the central outer ring 6 is plugged onto the annular piston 8 and pushed to the stop on the right-hand outer ring 5. This central outer ring 6, too, comprises bolt openings 6*c* spread around the circumference. Furthermore, at a central position of the outer ring 6, an inwardly protruding and ring-shaped radial shoulder 6*d* is provided for, at the two front faces of which spur serrations 6*e* are configured which in turn extend in annular shape. The spur serrations 6*e* of the central outer ring are opposing each other by analogy to the ring-type serrations of the annular piston 8, i.e. the spur serration 6*e* shown in FIG. 2 at right points to the direction of the ring-type flange 4 of the same ring 3, whereas the spur serration 6*e* shown at left points to the opposite direction. And finally, an annular piston 9 built-up by analogy to annular piston 8 and thus identical in construction is inserted in this central outer ring 6, applying the same reference numbers and characters for the same components as for annular piston 8.

Finally, the outer ring 7 being the third and shown here at left is set onto annular piston 9 in turn set-on up to the stop versus the counter-serration, with the outer ring 7 in principle being identical in construction to the outer ring 5, so that comparable reference numbers have been applied, too.

The lateral (left-hand) closure is finally formed by the cover 80 which is also provided with bolt openings 8*c* spread around the circumference, through which the cover 80 can be firmly connected to the inner ring 2 via the bolted unions, with the bolted openings for these bolted unions on the side of the inner ring 2 in FIG. 2 having been designated with 3*c*.

To this extent, the cover 80 is fastened to the inner ring 4 and takes-up the three outer rings 5, 6, and 7 between the ring-type flange 4 and cover 80, wherein these three outer rings 5 to 7 overlap the two annular pistons 8 and 9 set onto the stock of the inner ring 2 and thus provide a chamber around them. The outer rings 5 to 7 form the casing of the rotary drive, and the outer rings 5 to 7 connected to form a unit are pivotally mounted relative to the inner ring 2 with its ring-type flange 4 and relative to the cover 80 fastened with the inner ring 2. To this extent, the outer rings 5 to 7 are rotatable versus the inner ring 2 with the cover 80 so that a rotary bearing is formed between the shaft-like inner ring 2 which is expediently configured as a hollow shaft, and the outer rings 5 to 7. If required, this rotary bearing can be configured as a merely sliding rotary bearing or as an anti-friction bearing, too.

Inner ring 2 with ring-type flange 4, cover 8 as well as the three outer rings 5, 6, and 7 here form a cylinder of a cylinder-piston arrangement within which the two annular pistons 8 and 9 are taken-up in reciprocating movement arrangement along the shaft of the inner ring 2.

Figure 3:
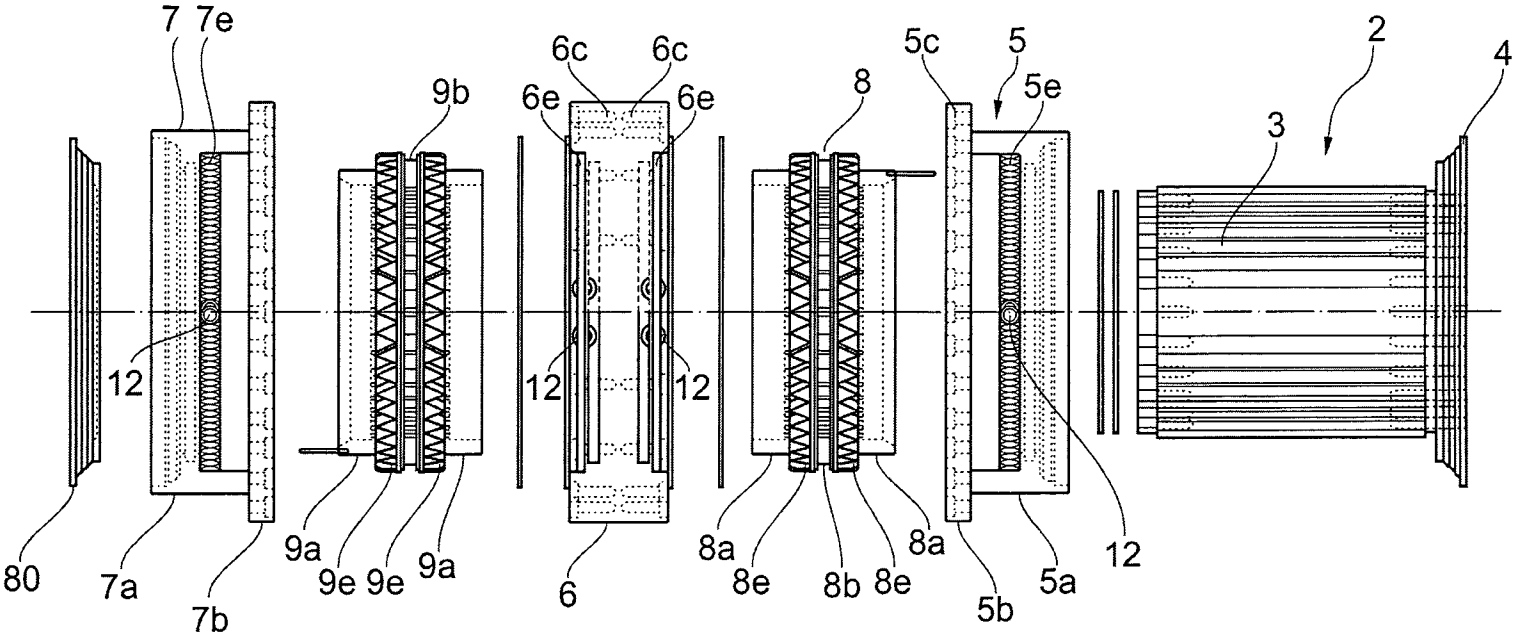
FIG. 3 is a side view of the embodiment of FIG. 1, also in an exploded view.

Besides, this set-up becomes evident from FIG. 3 in a side view, wherein the same reference numbers as those in FIG. 2 have been utilized in FIG. 3.

Recognizable from FIG. 3 in a purely schematic fashion are the hydraulic connections 12, i.e. relative to the outer ring 7 at left, the central outer ring 6 where two connections have been provided for, and relative to the outer ring 5 at right, with one hydraulic connection 12. Furthermore, this figure also shows appropriately usable spacer plates (shims) which need not be addressed in greater detail. The bolt openings are also indicatively shown in dashed lines. The annular pistons 8 and 9 are hydraulically driven, i.e. on both sides, which is the reason why two hydraulic connections 12 each are provided for each annular piston 8 or 9.

Figure 4:
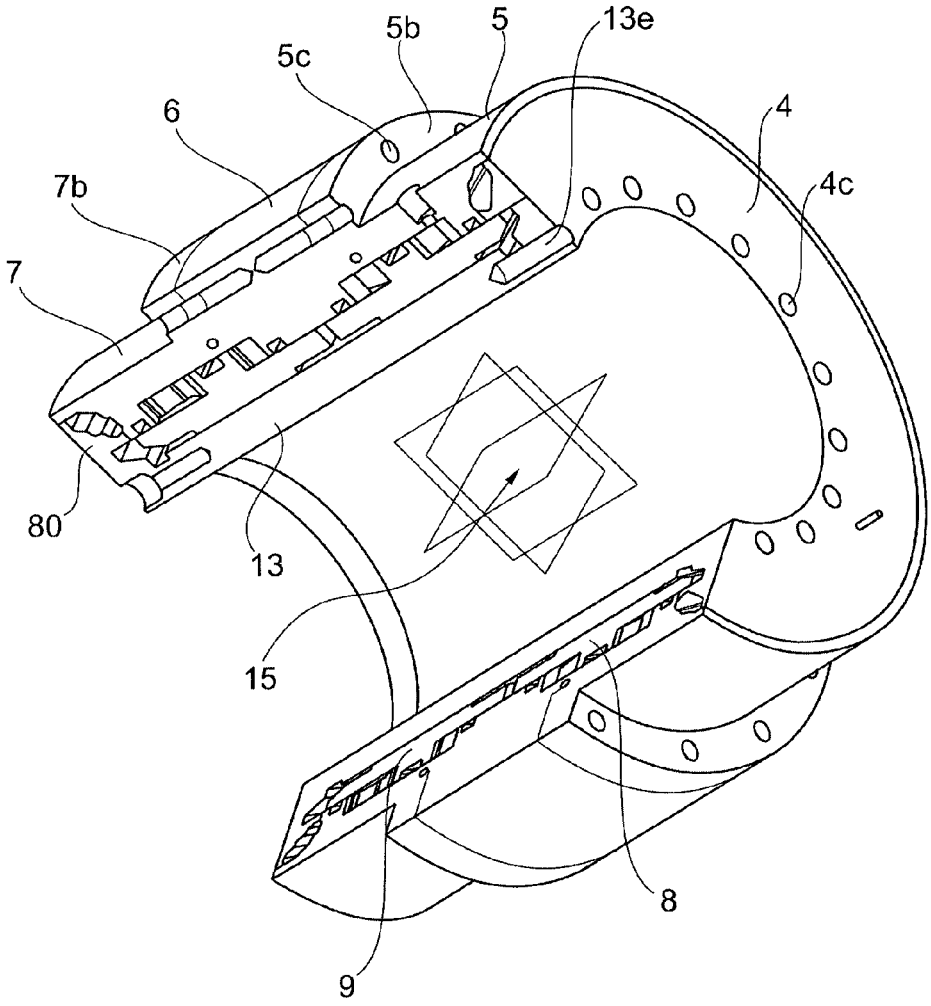
FIG. 4 is a representation of the hydraulic rotary drive in assembled status.

The assembly of those structural elements illustrated in FIGS. 1 to 3 may finally be gathered from FIG. 4 which shows the swivel drive 1 in assembled and partly sectioned position. Here, too, the same reference numbers as those in FIGS. 1 to 3 are used. From FIG. 4, it becomes quite clearly visible that the two annular pistons 8 and 9 are conducted axially movable within the set-up composed of the ring-type flange 4, cover 80, and the outer rings as well as the stock section of inner ring 2, and thus can be moved in translatory motion back and forth by way of a suitable hydraulic fluid feed via the hydraulic connections 12. From FIG. 4, it furthermore becomes evident that the ring-type flange 4 may be provided, if required, with openings 4*c* spread around the circumference so that it can be connected through bolted unions and/or bolts and/or pin connections to the stock 13 of the inner ring. A form-fit connection is expediently established here. To this effect, the stock 13 at its front face is provided with appropriate openings 13*e*. Accordingly, the inner ring 2 and the ring-type flange form a unit. As is quite clearly shown in FIG. 4, the outer ring 5 sits at the stop at ring-type flange 4 and the two other outer rings 6 and 7, too, are set at stop to each other and fixed on their front face by cover 80, thus taken-up firmly within the connection, though pivotally mounted. As is quite clearly shown in FIG. 4, these two annular pistons 8 and 9 mounted in a quasi axially floating arrangement can be moved axially in the direction of the limitation of the serration of the outer rings. As a matter of fact, the pistons, including the axially outwardly protruding shoulder 8*b*, are accordingly sealed so that by feeding hydraulic fluid on the left side and/or right side of the relevant piston it is translationally moved on the spline shaft of the inner ring 2 between the positions of indentation with the serrations.

The hydraulic drive of both annular pistons is offset to each other so that these are moved to each other so to say in alternating movement. A constant rotary drive can thus be enabled. In particular, the two hydraulically driven annular pistons are controlled alternating to each other offset by half a stroke. The control is performed in a suitable manner, and it is preferably operated mechanically, i.e. by a control disk which is not shown here and which controls the switching pulses for the relevant hydraulic valves for supplying hydraulic fluid to the two annular pistons. Such a mechanical control is advantageous because it enables a non-adulterated control in any operating status. This is significant for the indentation position of the interacting spur serrations. For example, with the offset stroke arrangement of the pistons by half a stroke, one of the annular pistons is in its end position while the other piston is in a middle indentation position. Moreover, the drive of the corresponding piston is briefly idling during the phase of changing the travel direction.

Figure 5:
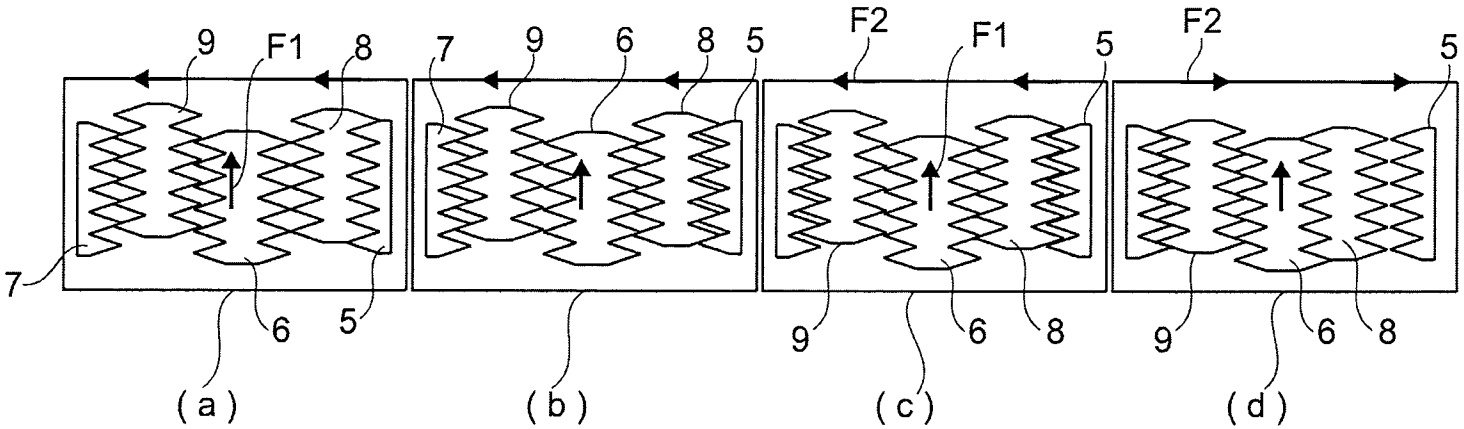
FIG. 5 is a sequential representation of the structural elements of the rotary drive during part of the cycle run during a piston movement.

FIG. 5 gives an example of the sequencing of indentation positions of the two annular pistons in relation to the spur serrations of the outer rings. The sequencing illustrated in FIG. 5 indicates a rotary drive in which the three outer rings are moved clockwise as designated by arrow F1 in FIGS. 5*a* to 5*d*. The arrows F2 indicate the direction of stroke, i.e. the translator motion of the two annular pistons. It should be noted that FIG. 5 again is a mere schematic representation. Therefore, the annular pistons and outer rings are designated only with the corresponding reference numbers 5 to 9, without providing the corresponding reference numbers for the spur serrations of the individual components. As becomes evident, the serrations of both annular pistons 8, 9 engage alternately into the corresponding serrations of the corresponding outer rings, i.e. in this case the annular piston 8 alternately into the outer rings 5 and 6 as well as annular piston 9 alternately into the outer rings 6 and 7. For example, if the annular piston 9 with its serration shown at left in FIG. 5 moves to the left in figure (a) and engages into the corresponding serration of the left outer ring 7, it is turned clockwise, wherein the right serration of the annular piston 9 leaves the indentation with the corresponding serration of the middle outer ring. The same applies to the serration of the annular piston 8. Due to the reciprocating movement, it results an alternating indentation so that the swivel drive can be turned about an arbitrary angle, i.e. in a constant rotary movement which can be precisely controlled. By adapting the geometry of the serration in its direction in height, it is moreover feasible to achieve a flank adaptation of the contact faces of the serrations which takes the effect that the largest possible area of the teeth can be utilized for the contact in the position of indentation. Via the indentation of the serrations, it is evidently achieved that the outer rings are turned by the spline power of the forces occurring at the tooth flanks.

Figure 6:
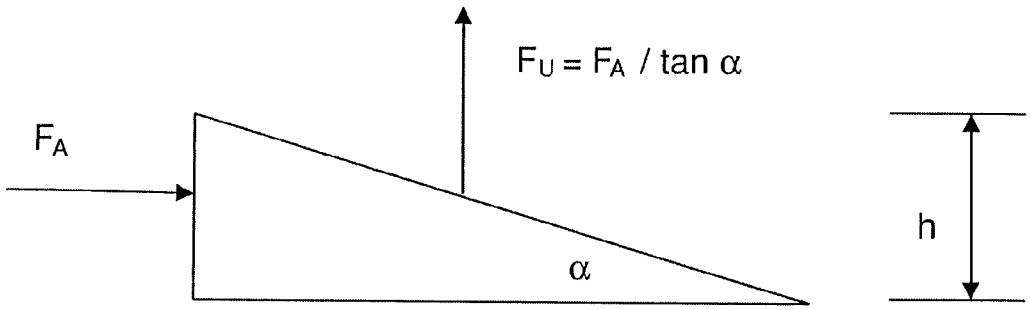
FIG. 6 is a schematic representation of the effect of the splined serration between the annular piston and the outer ring.

FIG. 6 indicates the basic principle of the splined serration. The serrations at the annular pistons engage into the serration of the outer rings and thus transform the axial force of the piston movement $F_A$ into a rotary force $F_U$. Thus, with each piston stroke, a rotary movement by the amount h of the opposite leg is thus effected.

FIGS. 5*a* to 5*d* show the clockwise rotation of the outer rings. By reversing the stroke sequence of the annular pistons driven via a control disk, it is feasible to set an opposite direction of rotation, i.e. the rotary drive of the outer rings runs anti-clockwise, which, however, is not reflected in the sequencing of the representations in FIG. 5.

Not depicted either in these figures is the allocation of the structural elements of the rotary drive to the boom arms which, however, is a matter of fact to someone being skilled in the art. For example, one of the two boom arms which can be pivoted relative to each other can be solidly connected to the ring-type flange 4 and/or the cover of the inner ring 2, whereas the other boom arm which is to be pivotable relatively to the first boom arm by means of the rotary drive can be secured with one or several outer ring(s). By a corresponding rotation of the swivel drive, the entanglement and/or swiveling of both boom arms relatively to each other can be accomplished, with the rotary drive being absolutely constant and with an arbitrary swiveling of the boom arms relatively to each other being enabled in an extraordinarily compact design of the construction, depending on the design of the boom arm construction.

Depending on the design of the boom arms that can be swiveled relatively to each other, it is thus possible to utilize only one hydraulic rotary drive, but even two or more hydraulic rotary drives, in particular those being axially aligned, can be utilized per articulation axis. Expediently, even more than two annular pistons can be utilized in the rotary drive so that the rotary drive may be configured, for example, as a 3-piston system. Eventually this depends on the design of the hydraulic rotary drives and also on the design of the boom arms and their size as well as planned load pick-up.

On indentation of the interacting spur serrations between the annular pistons and the relevant outer rings, the control is so effected that when moving the serration of an annular piston into the serration of a corresponding outer ring, the teeth are definitively moved into a corresponding tooth gap, i.e. tooth peak does not move to tooth peak, so that on moving-in the spur serration of the annular pistons, the driving flanks of the teeth of the spur serration each accomplish the rotation of the corresponding outer ring, including the other outer rings torque-proof connected thereto.

Figure 7:
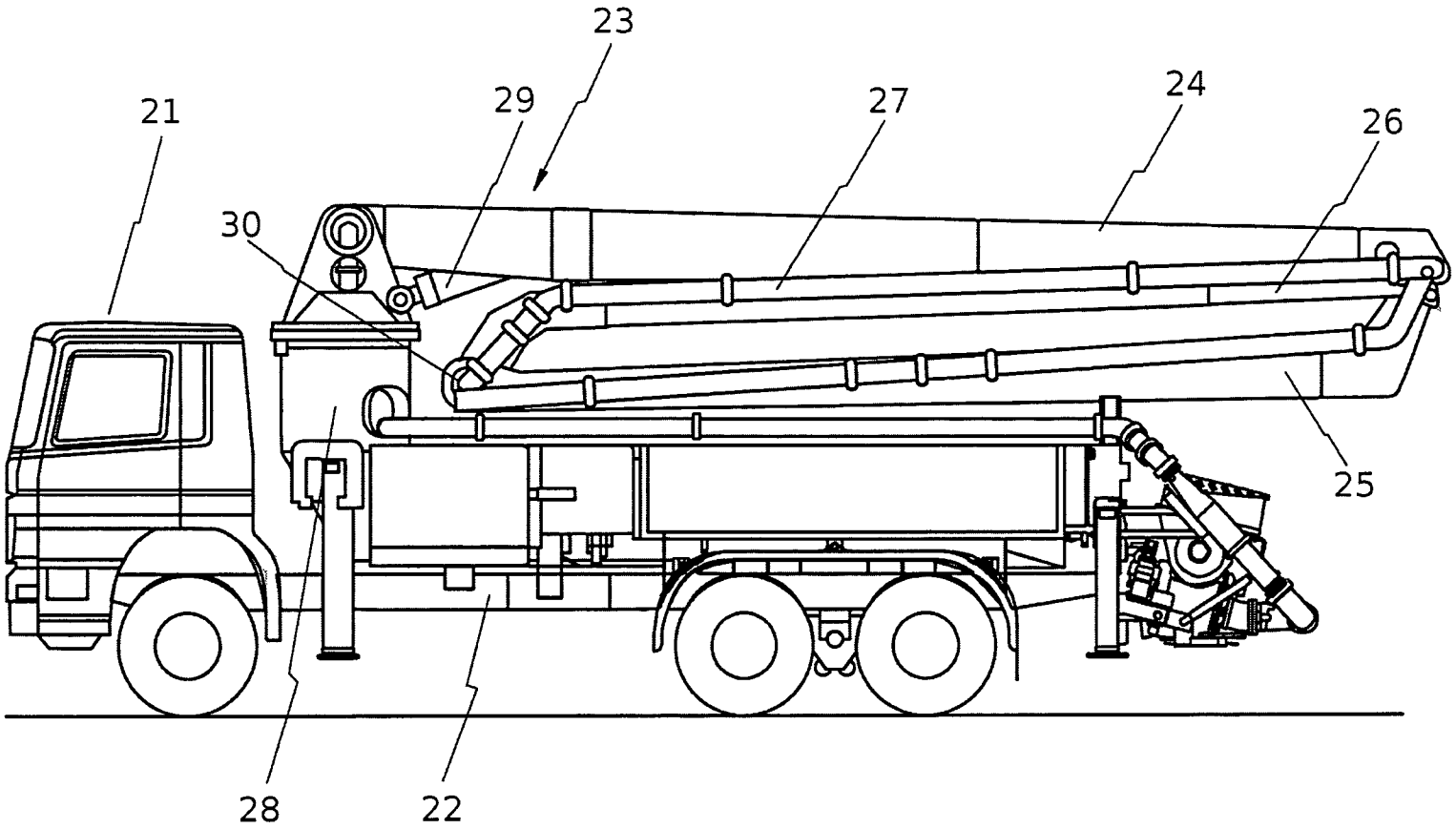
FIG. 7 is a representation of the case of application of a truck-mounted concrete pump.

Just to serve as an example, a preferred application of the invention is illustrated based on FIG. 7. Accordingly, FIG. 7 shows a mobile truck-mounted concrete pump with a driver cabin 21 on a vehicle chassis 22, on which a concrete pump is mounted. Furthermore, FIG. 7 shows a boom construction 23 comprised of three boom arms 24, 25, and 26 in total which at their ends are connected through articulated joints and which can be pivoted and which moreover carry the pipe delivery lines 27. The boom construction 23 is arranged on a turntable 28 and thus in total also pivotable about a vertical axis. FIG. 7 shows a conventional vehicle in which for pivoting the boom arms, hydraulic pistons in the type of thrust piston gears (29) are utilized which are replaced with the inventive rotary drive. For example, the boom arms 25 and 26 are inventively pivoted by a hydraulic rotary drive, wherein in this case the inner ring and/or cover 80 and/or ring-type flange 4 can expediently be firmly connected with the boom arm 26 and the boom arm 25 can be firmly connected with the outer rings 5 to 7. By way of an appropriate cycling of the annular pistons, the pivoting of the two boom arms 25 and 26 can be accomplished relatively to each other. This results in an exact angle-precise extension motion which can be repeatedly approached precisely within the scope of the overall controlling. Due to the ring-shaped configuration of the structural elements, the hollow space 15 through the rotary drive which becomes evident from FIG. 4 due to the ring-shaped configuration of the structural elements moreover enables the delivery line 27 to penetrate the central point of the articulation 30 as becomes evident from FIG. 7.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The invention claimed is:

1. A boom construction for truck-mounted concrete pumps, comprising; at least a first boom arm and a second boom arm that are articulatedly jointed to each other and that are rotatable relatively to each other about an axis; a drive for pivoting the boom arms; and a piston-cylinder arrangement and a gear for transforming piston reciprocating movement into rotary movement for boom arm pivoting, said arrangement having first and second hydraulically driven annular pistons that form part of the gear and that interact with the outer rings of the gear.

2. The boom construction of claim 1, further comprising a central inner ring formed by a spline shaft, with the annular pistons configured with a complementary splined serration being located on said inner ring in a rotatably secured arrangement, and axially slidable in a row one behind the other, and wherein the outer rings interact with the annular pistons that are arranged rotatably, and secured axially secured.

3. The boom construction of claim 2, wherein the inner ring on a first side is configured with an annular flange and on a second side is provided with a flange-type cover that can be fastened to the inner ring, and wherein the annular pistons and the outer rings are arranged between the cover and the ring-type flange, and wherein the inner ring together with the ring-type flange the cover and the outer rings form the cylinder for the annular pistons and limits axial reciprocating movement of the annular pistons on the inner ring, with the spur serrations of the annular pistons and outer rings representing the gear of the rotary drive.

4. The boom construction of claim 3, wherein the first boom arm is linked to the ring-type flange and/or to the cover, and wherein the second boom arm is at least linked to one of the outer rings.

5. The boom construction of claim 2, wherein the two annular pistons and the three outer rings are arranged on the inner ring.

6. The boom construction of claim 5, wherein a first outer ring of the outer adjacent the ring-type flange has a first outer ring spur serration pointing away from the ring-type flange, said first outer ring spur serration being configured at a first circumferential inner shoulder of the first outer ring, wherein a first annular piston of the annular pistons adjacent the ring-type flange has a first piston spur serration pointing toward the ring-type flange for indentation with the first outer ring spur serration, wherein a second outer ring of the outer ring adjacent the cover on its inner circumference has a second outer ring spur serration pointing towards the ring-type flange at a second inner shoulder, said second outer ring spur serration interacting with a second piston spur serration pointing away from the ring-type flange of the adjacent annular piston in the cover, and wherein a third outer ring of the outer rings is arranged between the first and the second outer rings, said third outer ring comprising two third outer ring spur serrations, thereof the first of the two third outer ring spur serrations adjacent the ring-type flange pointing to the ring-type flange and the second of the two third outer ring spur serrations adjacent the cover pointing away from the ring-type flange, both the first and second of the two third outer ring spur serrations being arranged each at a third inner shoulder of the third outer ring, and wherein the first and second of the two third outer ring spur serrations each interact with the respective first and second piston spur serrations.

7. The boom construction of claim 6, wherein the first outer ring spur serration and the first piston spur serration are configured complementary to each other, and second outer ring spur serration and second piston spur serrations are configured complementary to each other.

8. The boom construction of claim 6, wherein the first piston spur serrations of each annular piston are is centrally arranged on an outer circumference of the first annular piston and the second piston spur serration is centrally arranged on an outer circumference of the second annular piston.

9. The boom construction of claim 6, wherein the cover is connected using bolted unions spread around the circumference of the cover to a front side of the inner ring opposing the ring-type flange, and wherein the first, second and third outer rings are connectible to each other via bolted unions each arranged around the circumference, and wherein the structural elements of the rotary drive, in particular the cover, annular piston, outer rings, and inner rings are configured with a flange, hollow, in particular ring-shaped, and form a central hollow space through the rotary drive for lead-through of pipelines, cables, and the like.

10. The boom construction of claim 6, wherein the first and second annular pistons on the inner ring are movable within the limitation of the respective spur serrations of the outer rings.

11. The boom construction of claim 1, wherein each annular piston has two ring-shaped spur serrations that point away from each other and interact with complementary ring-shaped spur serrations of the outer rings.

12. The boom construction of claim 1, wherein the first and second outer ring spur serrations, first and second piston spur serrations, and two third outer ring spur serrations are so configured that reciprocating movement of the annular pistons is transformed due to the indentation of the spur serrations into a rotary movement of the outer rings.

13. The boom construction of claim 1, wherein the first and second annular pistons are stroke-wise offset, in particular hydraulically driven alternating to each other offset by half a stroke, and wherein two hydraulic connections for bilateral charging of each of the first and second annular pistons with hydraulic fluid are allocated to each of the first and second annular pistons.

14. The boom construction of claim 13, wherein control of the first and second annular pistons is performed mechanically by means of a control disk that determines switching pulses for relevant hydraulic valves for a hydraulic fluid supply to the first and second annular pistons.

15. A concrete pump vehicle comprising:

a vehicle;

a concrete pump on the vehicle;

a delivery line connected to the concrete pump; and a boom construction on the truck and connected to the delivery line, comprising:

at least two boom arms with at least one boom arm being pivotable relative to the other boom arm; and a piston-cylinder arrangement and a gear for transforming piston reciprocating movement into rotary movement for boom arm pivoting, said arrangement having first and second pistons that form part of the gear and that interact with outer rings of the gear.

16. A hydraulic rotary drive for a boom construction or a turntable carrying a boom construction, wherein the boom construction has at least two boom arms, and wherein the drive comprises a piston-cylinder arrangement and a gear for transforming piston reciprocating movement into rotary movement for boom arm pivoting, said arrangement having first and second pistons that form part of the gear and that interact with outer rings of the gear.

* * * * *